US005083825A

United States Patent [19]

Bystrom et al.

[11] Patent Number: 5,083,825

[45] Date of Patent: Jan. 28, 1992

[54] BAG CARRIER HANDLE

[76] Inventors: Benjamin L. Bystrom, 5446 Kirkwood Pl., Honolulu, Hi. 96821; Andrew P. Bystrom, 123 W. Lomita Ave., #9, Glendale, Calif. 91204

[21] Appl. No.: 504,819

[22] Filed: Apr. 5, 1990

[51] Int. Cl.[5] ..... A45C 13/26; B65D 33/06

[52] U.S. Cl. ..... 294/171; 383/13

[58] Field of Search ..... 294/171-137, 294/165-167, 169, 170; 16/114 R, 114 B; 24/16 PB; 383/6, 13, 25, 29

[56] References Cited

U.S. PATENT DOCUMENTS

| | | | |
|---|---|---|---|
| 824,904 | 7/1906 | Cammett . | |
| 1,401,854 | 12/1921 | Almedia . | |
| 2,274,605 | 2/1942 | Hoffmeister | 16/114 B X |
| 2,319,316 | 5/1943 | Gerendas . | |
| 3,912,140 | 10/1975 | Franges . | |
| 3,913,172 | 10/1975 | Richards et al. . | |
| 4,004,722 | 1/1977 | Olivier . | |
| 4,040,562 | 8/1977 | Ward et al. . | |
| 4,112,541 | 9/1978 | Tetradis . | |
| 4,262,385 | 4/1981 | Norman | 294/171 X |
| 4,590,640 | 5/1986 | Enersen . | |
| 4,637,097 | 1/1987 | Secord | 24/16 PB |
| 4,796,936 | 1/1989 | Sherin | 294/165 X |
| 4,890,355 | 1/1990 | Schulten | 294/171 X |

FOREIGN PATENT DOCUMENTS

| | | | |
|---|---|---|---|
| 3347410 | 7/1985 | Fed. Rep. of Germany | 294/171 |

*Primary Examiner*—Margaret A. Focarino
*Assistant Examiner*—Dean J. Kramer
*Attorney, Agent, or Firm*—John J. Posta, Jr.

[57] ABSTRACT

The improved handle is for a bag or bag carrier and has provision for the insertion of a bag strap inside thereof and for the releasable removal thereof. The handle includes an inner core in the form of a substantially rigid tube defining a central hollow space the length thereof with open ends. The tube is divided into two longitudinally extending parts the length thereof, having a pair of spaced junction lines therebetween. The handle also includes a flexible, resilient elongated outer shell having a hollow interior and a split line the entire length thereof. The shell is fixedly secured to the outer surface of the core parts and is releasably openable at the split line to separate the parts at one of the junction lines for access to the central space in order to releasably dispose the bag carrier strap therein. The outer shell may be of elastomeric material and the inner core may be of metal, wood, plastic or the like. A closure releasably holds the handle shut. The closure may be a first velcro-type strip on the inner surface of the outer shell and a second such strip on the outer surface of the inner core connectable therewith. Alternatively, the two velcro-type splits may be positioned on the outer surface of the outer shell on opposite sides of the split line and be capable of bridging it. The outer shell can be divided into two halves hinged together. The handle is simple, effective and reusable.

9 Claims, 1 Drawing Sheet

BAG CARRIER HANDLE

BACKGROUND OF THE INVENTION

1. Field of the Invention

The present invention generally relates to carrier means and more particularly to an improved handle for a bag or the like.

2. Prior Art

Various types of handles have been proposed in the past to assist in carrying container bags and the like. See, for example, the various handles shown and described in the following U.S. Pat. Nos.: 824,904; 3,913,172; 4,040,562; 2,319,316; 3,912,140; 4,004,722; 4,112,541; 1,401,854; and 4,590,640. Such devices range in complexity from the simple handle with string grip to the complicated locks and grips sometimes found for securing mailbags and the like. Most such handles are to be more or less permanently installed. Those which are intended to be reusable are sometimes complicated and difficult to install and remove.

There remains a need for an improved simple and efficient reusable bag handle which is easy to install and remove and is durable and inexpensive.

SUMMARY OF THE INVENTION

The improved bag carrier handle of the present invention satisfies all the foregoing needs. The handle is substantially set forth in the Abstract of the Disclosure.

Thus, the carrier handle is generally cylindrical and elongated and is formed of two main portions, an inner substantially rigid elongated core, which is split transversely into a mating pair of longitudinally extending parts, and a flexible resilient outer shell of rubber or the like having a longitudinal split therein. The outer shell is sealed to the two inner core parts with adhesive or the like and is arranged so that it can open along the split for access to the hollow interior of the core in order to place therein and remove therefrom a bag carrier strap or the like. The handle is releasably held shut through the use of two VELCRO-type hook and pile closures, one of which may be disposed on the outer surface of the inner core and the other on the inner surface of the outer shell. Alternatively, both VELCRO-type hook and pile fasteners may be disposed on opposite sides of the split in the outer surface of the outer shell and may releasably bridge the same. In one embodiment, the shell and core are divided into two halves and the halves of the shell are hinged together and velcroed in place for easy access to the interior of the core.

Various other features of the improved handle of the present invention are set forth in the following detailed description and the accompanying drawings.

DRAWINGS

DETAILED DESCRIPTION

Figure 1:
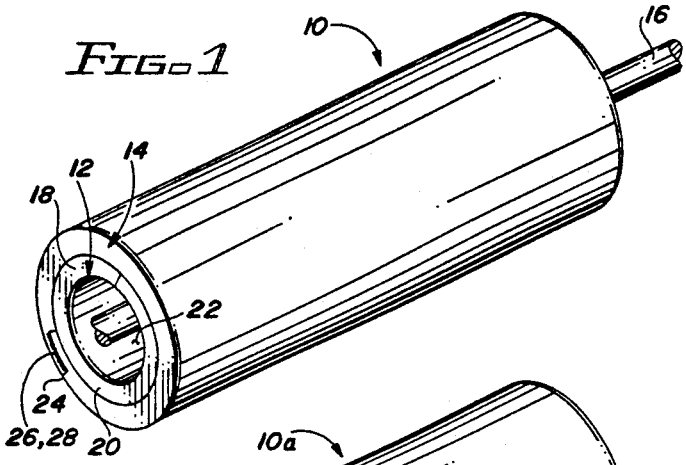
FIG. 1 is a schematic side perspective view, partly broken away, of a first preferred embodiment of the improved bag carrier handle of the present invention, shown disposed around a bag carrier strap.
Figure 2:
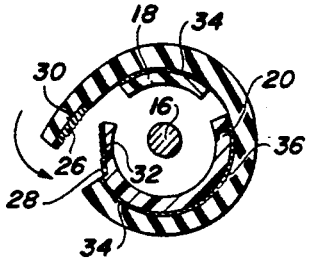
FIG. 2 is a schematic end view of the handle of FIG. 1 shown in the open position, with a bag carrier strap in place.

FIGS. 1 and 2

Now referring more particularly to FIGS. 1 and 2 of the accompanying drawings, a first preferred embodiment of the improved bag carrier handle of the present invention is schematically depicted therein. Thus, handle 10 is shown, which comprises an inner, hollow, substantially rigid core 12 with a hollow, resilient flexible outer shell 14 wrapped therearound and adhering thereto as by adhesive or the like. Handle 10 is shown disposed around a bag carrier strap 16 or the like of cloth, rope, etc.

Core 12 may be of metal, plastic, wood, ceramic, cermet, hard rubber or the like and is a generally cylindrical tube which is split transversely radially along the entire length thereof into two longitudinally extending mating parts 18 and 20 of unequal size. Core 12 defines a central passageway 22 extending the length thereof and open at opposite ends, and in which strap 16 lies.

Outer shell 14 has a split 24 the entire length thereof. VELCRO-type hook and pile fasteners in the form of strips 26 and 28 are recessed in and secured to pockets 30 and 32, respectively, on the inner surface of outer shell 14 adjacent to split 24 and on the outer facing surface of part 20, respectively. It will be noted that an adhesive layer 34 attaches parts 18 and 20 to shell 14 only in the areas shown in FIG. 2 so that handle 10 can be opened and closed easily by strips 26 and 28 in order to provide access of strap 16 to passageway 22.

With the described arrangement, handle 10 is kept smooth and essentially seamless and comfortable and yet can be easily opened and closed for use and reuse as needed. Handle 10 is simple and efficient, as well as durable and inexpensive.

FIG. 3

Figure 3:
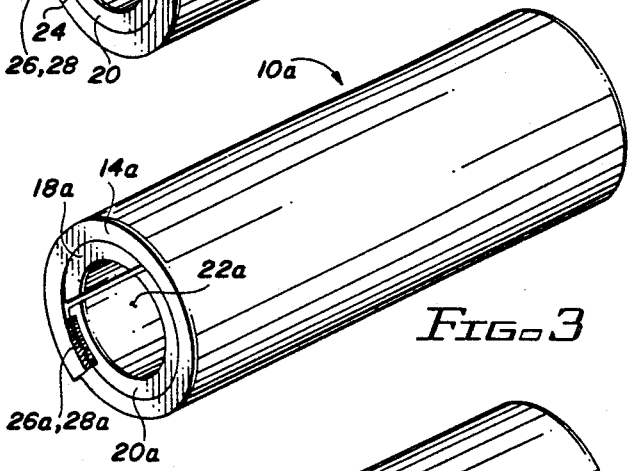
FIG. 3 is a schematic perspective side view of a second preferred embodiment of the improved bag carrier handle of the present invention.
Figure 4:
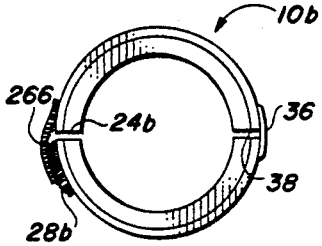
FIG. 4 is a schematic end view of a third preferred embodiment of the improved bag carrier handle of the present invention shown in the closed position.
Figure 6:
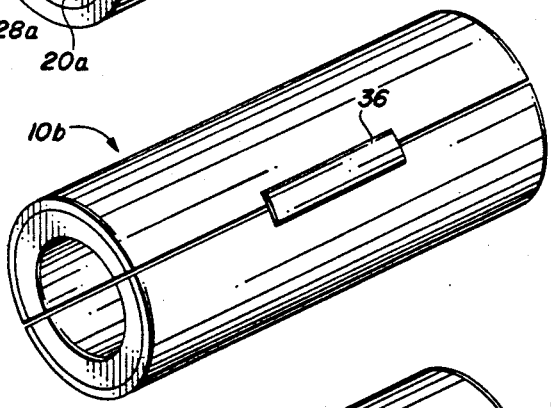
FIG. 6 is a schematic side perspective view of the bag carrier handle of FIG. 4, showing the hinge portion of the handle; and, FIG. 7 is a schematic side perspective view, partly broken away, of the bag carrier handle of FIG. 4, showing the velcro strips thereof.
Figure 5:
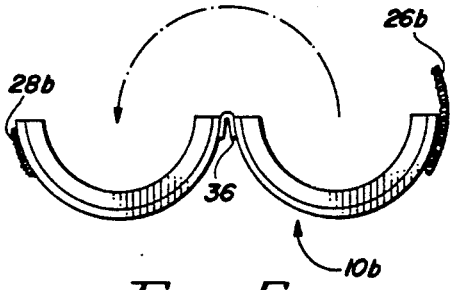
FIG. 5 is a schematic end view of the bag carrier handle of FIG. 4 shown in the open position.
Figure 7:
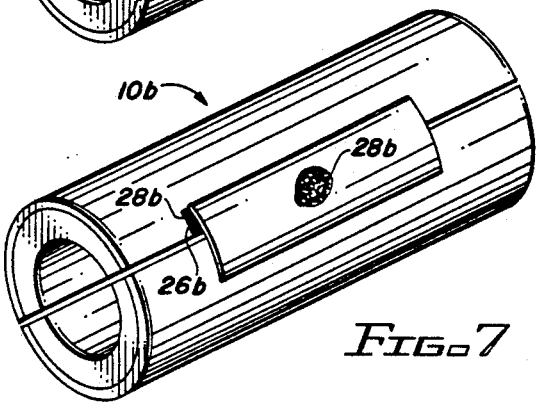

A second preferred embodiment of the improved bag carrier handle of the present invention is schematically depicted in FIG. 3. Thus, handle **10*a* is shown. Components thereof similar to those of handle 10** bear the same numerals but are succeeded by the letter "a".

Handle **10*a* is substantially identical to handle 10**, except as follows:

*a*) core **12*a* is split into parts 18*a* and 20*a* by a non-radial transverse split line; and, b) VELCRO-type hook and pile strip 26*a* is not recessed into a pocket in the inner surface of outer shell 14*a*** but adheres directly to that surface.

Handle **10*a* has substantially the advantages and properties of handle 10**.

FIGS. 4–7

A third preferred embodiment of the improved bag carrier handle of the present invention is schematically depicted in FIGS. 4–7. Thus, handle **10*b*** is shown.

Components thereof similar to those of handle 10 bear the same numerals but are succeeded by the letter "b".

Handle 10*b* differs from handle 10 only as follows:

a) both core 12*b* and outer shell 14*b* are split into two equal halves;

b) an external flexible resilient hinge 36 of cloth, rubber, or the like is connected, as by adhesive or the like, to the outer surface of outer shell 14*b* over a longitudinal split 38 in outer shell 14*b;* c) the outer surface of outer shell 14*b* is roughened and corrugated for better gripping by the person carrying a bag using handle 10*b;* and, d) both VELCRO-type hook and pile fasteners 26*b* and 28*b* are secured to the outer surface of outer shell 14*b* on opposite sides of split 24*b,* with fastener 26*b* long enough to bridge over split 24*b* so as to releasably hold handle 10*b* shut.

Handle 38 has the other advantages and properties of handle 10.

Various other modifications, changes, alterations and additions can be made in the improved bag carrier handle of the present invention and in the components and parameters thereof. All such modifications, changes, alterations and additions as are within the scope of the appended claims form part of the present invention.

What is claimed is:

1. An improved bag carrier handle for carrying a bag having a flexible strap, said handle comprising, in combination:

a) a core comprising an elongated substantially rigid tube defining a hollow, bag strap-receiving space, said tube being divided into two longitudinally extending mating parts having a spaced pair of junction lines therebetween, b) a flexible, resilient elongated outer shell having a hollow interior and a split line extending thereinto the entire length of said shell, said shell being fixedly secured to the outer surface of said core parts and releasably openable at said split line to separate said parts at one of said junction lines for access to said space in order to releasably dispose a bag carrier strap therein;

c) said core presenting a continuous inner surface of approximately 360 degrees when the handle is in a closed position, and d) whereby said rigid tube supports said flexible strap without being significantly deformed.

2. The improved handle of claim 1 wherein said outer shell bears separate closure means to releasably close said handle.

3. The improved handle of claim 1 wherein said parts are of unequal size.

4. The improved handle of claim 1 wherein said parts are of equal size.

5. The improved handle of claim 2 wherein said closure means comprises a first VELCRO-type hook and pile strip on the inner surface of said outer shell adjacent said split line and a second velcro-type strip on the outer surface of one of said core parts adjacent said first velcro-type strip and contactable therewith.

6. The improved handle of claim 2 wherein a first VELCRO-type hook and pile strip is disposed on the outer surface of said outer shell adjacent one side of said split line and a second VELCRO-type hook and pile strip is disposed on said outer surface of said outer shell on the opposite side of said split line from but adjacent to and overlappable by said first VELCRO-type hook and pile strip.

7. The improved handle of claim 6 wherein said outer shell is divided into two mating components by two split lines extending the length thereof and wherein one of said split lines is bridged by a flexible hinge, while the other of said split lines is bridged by said first and second VELCRO-type hook and pile strips.

8. The improved handle of claim 1 wherein said outer shell is elastomeric.

9. The improved handle of claim 1 wherein said core comprises one of wood, metal, plastic, ceramic, and hard rubber.

* * * * *